US006000234A

United States Patent [19]

Baek

[11] Patent Number: 6,000,234

[45] Date of Patent: Dec. 14, 1999

[54] VENTILATING DEVICE OF WINDOW TYPE AIR CONDITIONER

[75] Inventor: Sang Kyun Baek, Kyungsangnam-do, Rep. of Korea

[73] Assignee: LG Electronics, Inc., Rep. of Korea

[21] Appl. No.: 08/892,057

[22] Filed: Jul. 15, 1997

[30] Foreign Application Priority Data

| | | | |
|---|---|---|---|
| Jul. 15, 1996 | [KR] | Rep. of Korea | 96-28500 |
| Jul. 15, 1996 | [KR] | Rep. of Korea | 96-28503 |
| Jun. 30, 1997 | [KR] | Rep. of Korea | 97-29739 |

[51] Int. Cl.[6] ..... F25D 23/12

[52] U.S. Cl. ..... 62/262; 62/427

[58] Field of Search ..... 62/262, 404, 410, 62/413, 427; 454/201

[56] References Cited

U.S. PATENT DOCUMENTS

| | | | |
|---|---|---|---|
| 5,056,333 | 10/1991 | Cho | 62/262 |
| 5,396,781 | 3/1995 | Mochizuki et al. | 62/262 |
| 5,706,672 | 1/1998 | Miyazaki | 62/427 |

FOREIGN PATENT DOCUMENTS 6-129669 5/1994 Japan .

*Primary Examiner*—Harold Joyce
*Attorney, Agent, or Firm*—Fish & Richardson P.C.

[57] ABSTRACT

A ventilating device of a window type air conditioner, which includes: a ventilating hole formed in a partition that connects the room portion with the outdoor portion of the air conditioner; a first lever which moves forward and backward in the discharge grill and the room portion; a lever guide portion that prevents the first lever from being deviated when the first lever is moved forward and backward, maintaining the horizontal state of the first lever; a damper on the back end portion of the first lever that opens and closes the ventilating hole with the forward/backward movement of the first lever; and a second lever which is formed on the front end of the first lever and is received in the room portion of the body during the shipment of the product, but is rotated in a straight line with the first lever, by an artificial force, to be exposed to the exterior of a front panel in the front end portion thereof, after installation of the product.

15 Claims, 17 Drawing Sheets

VENTILATING DEVICE OF WINDOW TYPE AIR CONDITIONER

BACKGROUND OF THE INVENTION

1. Field of the Invention

The present invention relates to a window type air conditioner, and more particularly, to a ventilating device of a window type air conditioner which is capable of supplying outdoor air to the inside of a room. By making the proper selection during air conditioning, the user ventilates the air inside the room with outdoor air.

2. Discussion of Related Art

Generally, an air conditioner is used to heat-exchange hot air in a room into cool air in order to air-condition the room to a predetermined temperature. Air conditioners are divided into three general types based on where they are installed. The first type of air conditioner is installed on the floor of a room; the second type of air conditioner is installed attachably on the wall surface of a room. The third type of air conditioner is installed in a window. The first and second types of air conditioners include an indoor device and an outdoor device which are separated from each other, and the third type of air conditioner integrates the room device and the outdoor device with each other.

First, the construction of a conventional window type air conditioner will be described with reference to FIGS. 1 to 4. The conventional window type air conditioner is comprised of: a body 1 that is attached in a window frame and that has a plurality of air holes 2 on both of its sides and the upper surface thereof. A front panel 5 is attachably/detachably coupled to the front surface of the body 1 and has an intake grill 3 and a discharge grill 4. A separating plate 6 is fixed in the interior of the body 1 and separates the body 1 into a room portion 1*a* and an outdoor portion 1*b*; a fan 7 is installed in the room portion 1*a* of the body 1 and rotates by the driving force of a motor (not shown) generating an intake force. A heat exchanger 8 is installed in the indoor portion 1*a* of the body 1 and heat-exchanges the hot indoor air which is pulled in through the intake grill 3 according to the rotation of the fan 7, transforming the indoor air into cool air.

Upon installation of the window type air conditioner described above, the front panel 5 is positioned in the room, and the plurality of air holes 2 on the body 1 is positioned outdoors.

When the air-conditioning mode is selected by turning dial 10, located on the control plate on the front panel 5, the air conditioner begins to run. The air conditioner runs at variable rates depending on the selected control signal.

More specifically, the rotating fan 7 generates an intake force that sucks the hot indoor air into the room portion 1*a* of the body 1 through the intake grill 3. At the same time, because the heat exchanger 8 executes a heat exchange operation, the hot air sucked into the room portion 1*a* is changed into cool air, while passing through the heat exchanger 8. The cool air is discharged into the room through the front panel 5 and the discharge grill 4 due to the force generated by the rotating fan 7. Thus, the room is air conditioned to a predetermined temperature.

Because the conventional window type air conditioner performs the air conditioning by continually circulating the air in the room, the air becomes impure if the air conditioning runs for a long time period. To solve this problem, the window type air conditioner includes a ventilating device, which selectively supplies outdoor air to the room and thus prevents the indoor air from becoming impure.

FIG. 1 provides a perspective view of a window type air conditioner having a conventional ventilating device, FIG. 2 is a cross-sectional view illustrating the main parts of FIG. 1 and FIG. 3 is a sectional view taken along the line I—I of FIG. 2. FIG. 4 is a perspective view of the conventional ventilating device of FIG. 1. In the first embodiment of the prior art, the ventilating device includes: a ventilating hole 11 in the separating plate 6, that connects the room portion 1*a* with the outdoor portion 1*b*. A lever 12, which moves forward and backward in the room portion 1*a* of the body 1, to expose the front end portion thereof to the outside of the front panel 5 through the discharge grill 4. The lever 12 maintains a horizontal state because a lever guide portion ensures that the lever is not deviated during its own forward/backward movement. A damper 13 on the back end portion of the lever 12 opens and closes the ventilating hole 11 during the forward/backward movement of the lever 12. A pair of grooves 14, which are formed opposite to each other, are located on the front end of the lever 12 and serve as a handle grip.

The lever guide portion is comprised of a vertical hole 15 which is vertically formed on the lever 12, a guide projection 16 which is formed in the bottom surface of the room portion 1*a* and is inserted into the vertical hole 15, and a screw 17 which is screwed on the guide projection 16 on the upper portion of the lever 12.

Now, the assembling process of such conventional ventilating device as mentioned above will be discussed. While the front panel 5 is not coupled with the front surface of the body 1, the guide projection 16 is inserted into the vertical hole 15, and then the screw 17 is screwed on the guide projection 16 on the upper portion of the lever 12. As a result, the lever 12 is located in the room portion 1*a* to be movable forwardly/backwardly, without deviation.

Thereafter, if the front panel 5 is coupled with the front surface of the body 1, the front end portion of the lever 12 is exposed to the exterior of the front panel 5 through the discharge grill 4.

The window type air conditioner attaches on a window 9, and if ventilation is desired in an air conditioning operation mode, a user grasps the pair of grooves 14 on the front end portion of the lever 12 and pulls the lever 12 forward. To the contrary, if ventilation is not desired, the user pushes the lever 12 backward.

The damper 13 closes the ventilating of hole 11, such that the room portion 1*a* and the outdoor portion 1*b* are not connected. In this case, although the air conditioner is in an air conditioning state, the outdoor air in the outdoor portion 1*b* that came in through the air holes 2 is blocked from entering the room portion 1*a*, and no ventilation is archived.

When the user pulls the lever 12 forward, the guide ensures that the lever moves horizontally in a forward direction. Accordingly, since the damper 13 opens the ventilating hole 11 in the separating plate 6, the outdoor air in the outdoor portion 1*b* is supplied to the room portion 1*a*. The outside air mixes with the air cooled by the heat exchange 8 and is discharged to the room through the discharge panel 4, FIG. 5 is a cross-sectional view illustrating the main parts of a window type air conditioner having a ventilating device constructed according to a second embodiment of prior art. FIG. 6 is a perspective view illustrating the lever of the ventilating device of FIG. 5. The ventilating device is well disclosed in Japanese patent publication number 6-129669. This embodiment provides a ventilating hole 21 in the separating plate 6. The ventilating hole 21 connects the room portion 1*a* with the outdoor portion 1*b*. A lever 22, which is hinge-installed to be horizontally rotatable, moves in the room portion 1*a* of the body 1, to expose the lever's front end portion to the outside of the front panel 5. A damper 23 formed on the back end portion of the lever 22 is rotated horizontally to open or close the ventilating hole 21.

An explanation of the assembly process for the conventional ventilating device is avoided because it is similar to that of the first embodiment of the conventional device, as discussed above. Meanwhile, the ventilation procedure during the air conditioning process will be explained.

If ventilation is desired, the front end portion of the lever 22, exposed to the exterior of the front panel 5, is pulled rotating the lever 22 counterclockwise. If ventilation is not desired, the lever 22 is rotated clockwise.

In the state shown by the solid line of FIG. 5, the damper 23 closes the ventilating hole 21, such that the room portion 1*a* and the outdoor portion 1*b* are not connected. In this case, although the air conditioner is in an air conditioning state, the outdoor air is not supplied to the room portion 1*a*, preventing ventilation.

Under the state shown by the dotted line of FIG. 5, if the user pulls the front end portion of the lever 22 counterclockwise because the lever 22 is hinge-installed at the bottom surface of the room portion 1*a*, the lever 22 rotates counterclockwise opening the ventilation hole 21.

Accordingly, since the ventilating hole 21 is opened, the outdoor air from the outdoor portion 1*b* mixes with indoor air in the room portion 1*a*. The mixed air passes through the heat exchanger 8 and cool ventilated air is discharged to the room through the discharge panel 4.

The ventilating devices of the first and second prior art embodiments, since the front end portion of the lever is exposed to the exterior of the front panel 5 when the assembly is complete, is problematic. First, upon package of the product for shipment, an increased package area is required to cover the exposed portion of the lever, thus increasing the cost of the package. Second, the number of products that can be loaded for delivery is reduced due to the increased packaging size, and thus the cost of delivery is increased. Finally, often during packaging and delivery, the packaging is torn off or the broken lever is often generated.

Moreover, the ventilating device of the first prior art embodiment is extremely complicated due to assembly of the lever, and the yield of production is accordingly decreased.

SUMMARY OF THE INVENTION

Accordingly, the present invention is directed to a ventilating device of a window type air conditioner that substantially obviates one or more of the problems due to the limitations and disadvantages of the related art.

An object of the invention is to provide a ventilating device for a window type air conditioner where the lever is not exposed to the exterior of a front panel during shipping. The front end portion of the lever is attached through the front panel's discharge grill after the product is placed in the window. By attaching the lever after shipping, the packaging for the product is reduced, and thus, the cost of packaging and delivery is decreased. The present invention also prevents the tearing off or the breakage of the lever.

Another object of the invention is to provide a ventilating device of a window type air conditioner that simplifies assembly of the lever structure so that it can move forward and backward in a horizontal state, without deviation, while increasing the yield of production.

To accomplish these and other objects of the present invention, a ventilating device of a window type air conditioner is disclosed. The air conditioner has a plurality of air holes on both of its sides and the upper surface of the body, a front panel attachably/detachably coupled on the front surface of the body and an intake and a discharge grill. The air conditioner also contains a partition fixed in the interior of the body that separates the body into a room portion and an outdoor portion. The ventilating device includes: a ventilating hole, which is formed in the partition, to connect the room portion with the outdoor portion. The ventilating device also contains a first lever which moves forward and backward through in the discharge grill in the room portion, and a lever guide portion which prevents the first lever from deviating while moved forward and backward. Additionally, the lever guide maintains a horizontal state of the first lever. A damper, which is formed on the back end portion of the first lever, opens or closes the ventilating hole. A second lever attaches to the front end of the first lever in the room portion of the body. The second lever is kept in the room portion during the shipment of product, and is straightened with the first lever exposing the second lever to the exterior of the front panel after the product is installed.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

Figure 1:
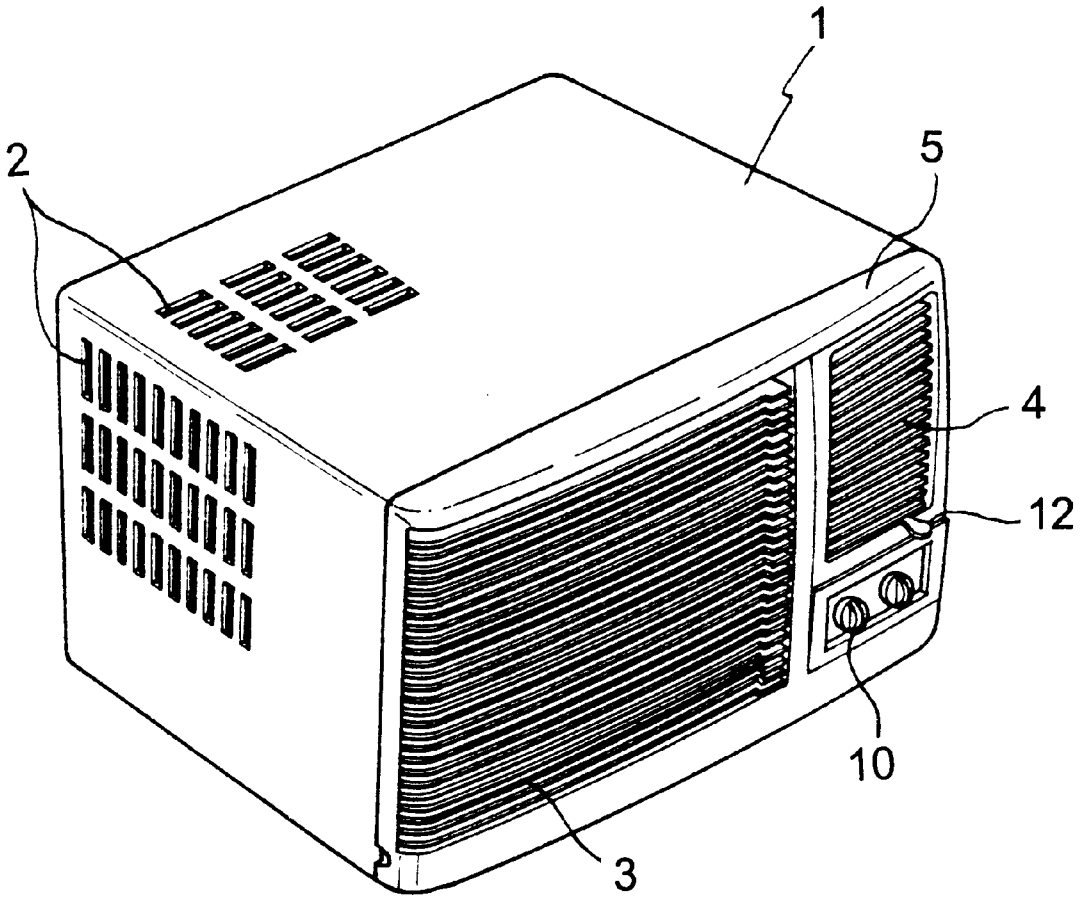
FIG. 1 PRIOR ART
FIG. 1 is a perspective view illustrating a window type air conditioner having a ventilating device according to the first embodiment of prior art.
Figure 2:
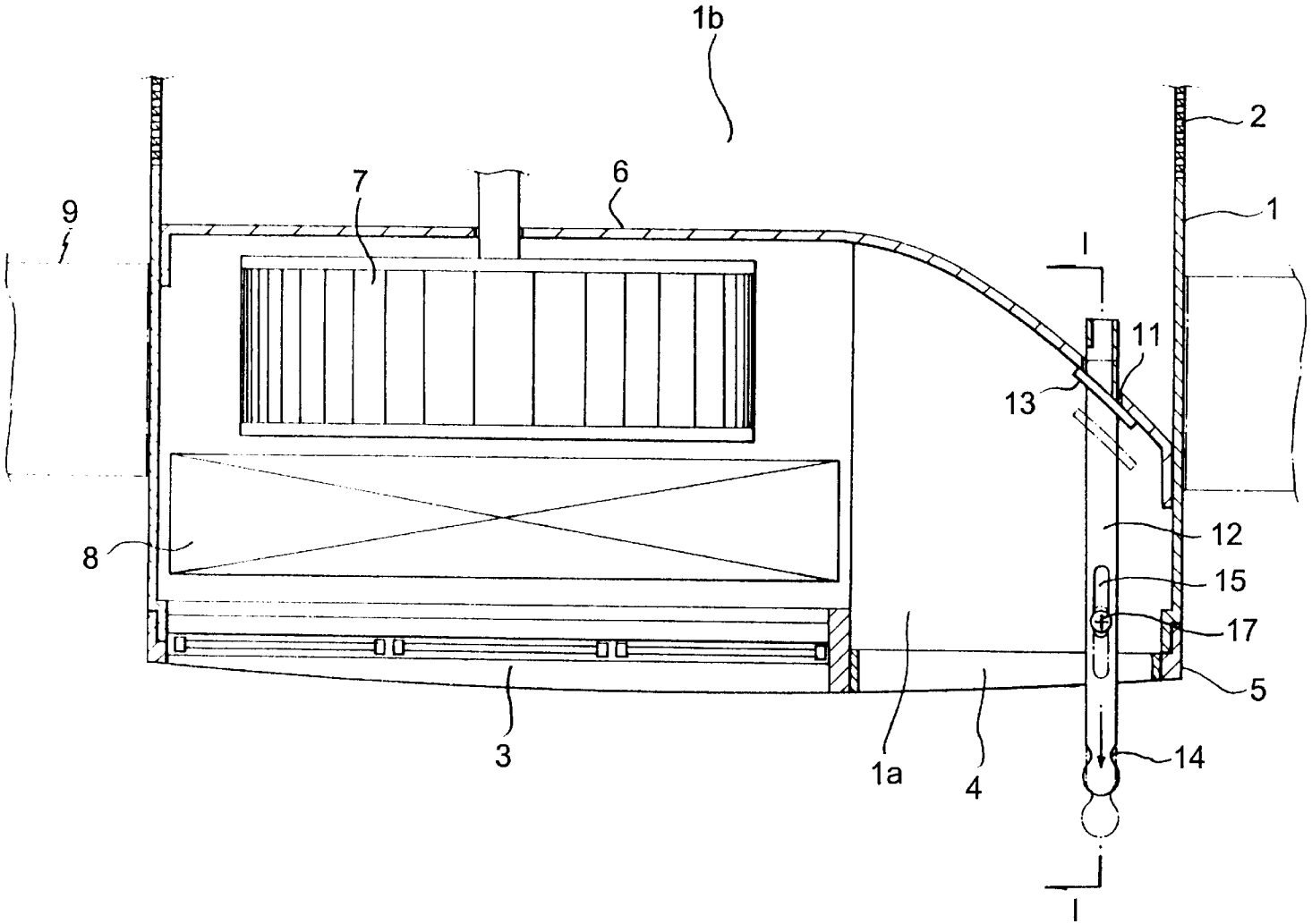
FIG. 2 PRIOR ART
FIG. 2 is a cross-sectional view illustrating the main parts of FIG. 1.
Figure 3:
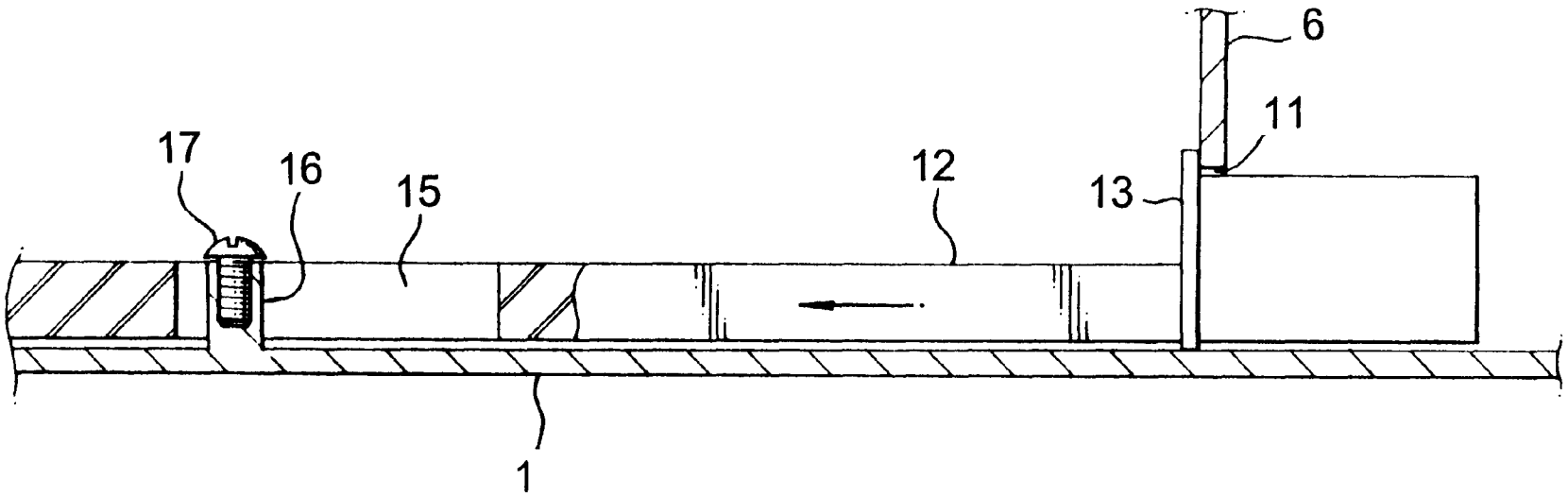
FIG. 3 PRIOR ART
FIG. 3 is a sectional view taken along the line I—I of FIG. 2.
Figure 4:
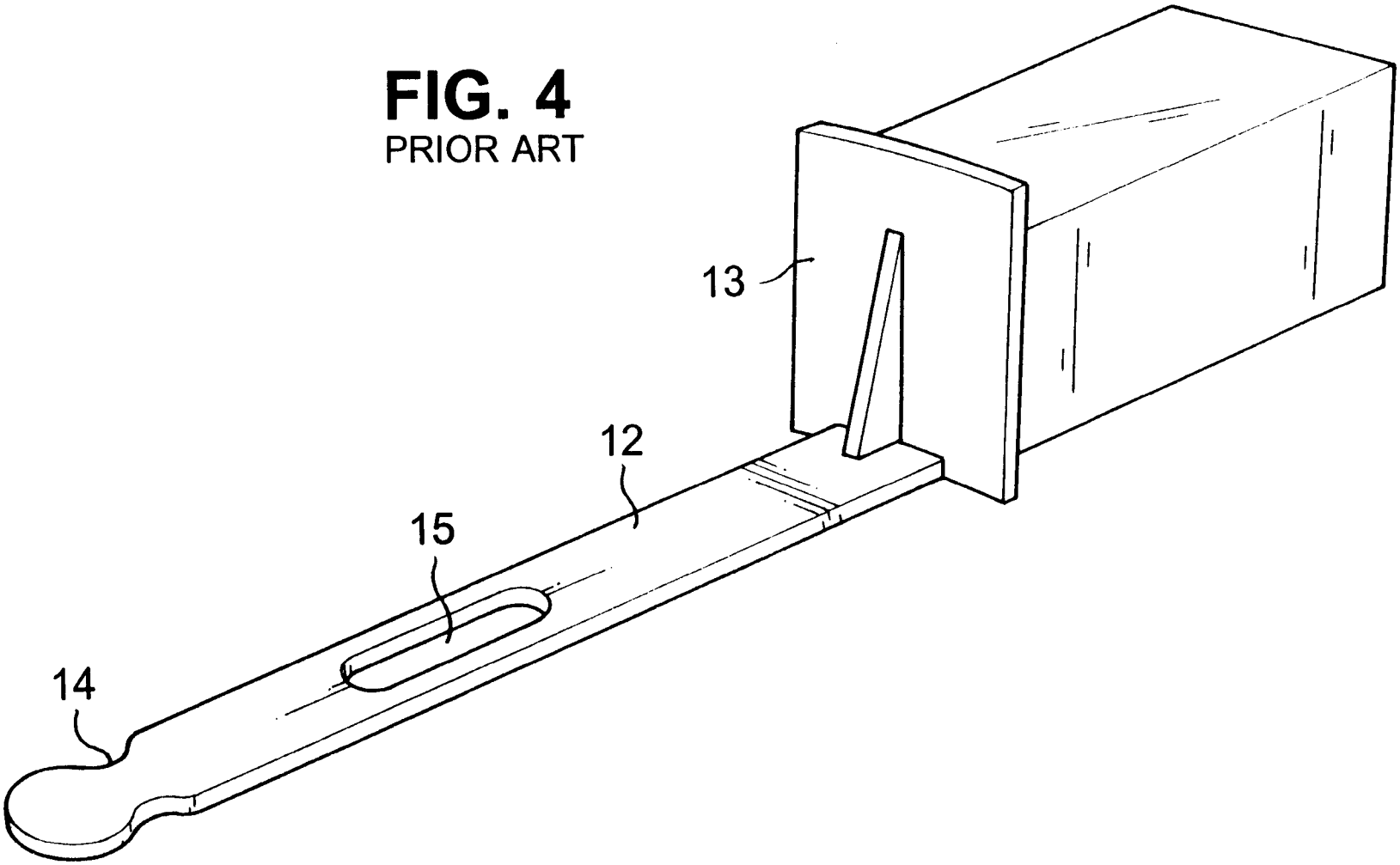
FIG. 4 PRIOR ART
FIG. 4 is a perspective view illustrating a lever constituting the ventilating device of FIG. 1.
Figure 5:
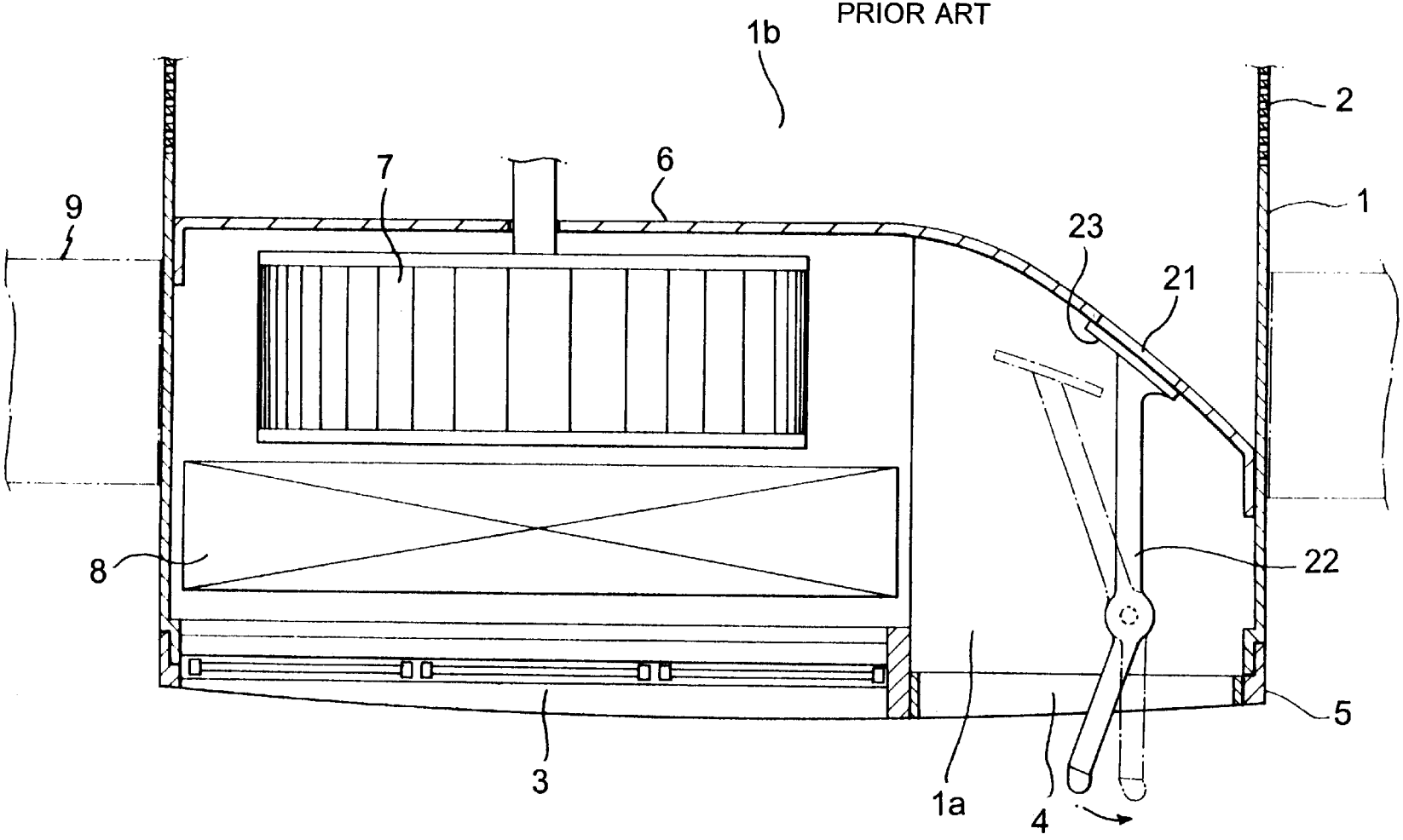
FIG. 5 PRIOR ART
FIG. 5 is a cross-sectional view illustrating main parts of a window type air conditioner having a ventilating device according to the second embodiment of prior art.
Figure 6:
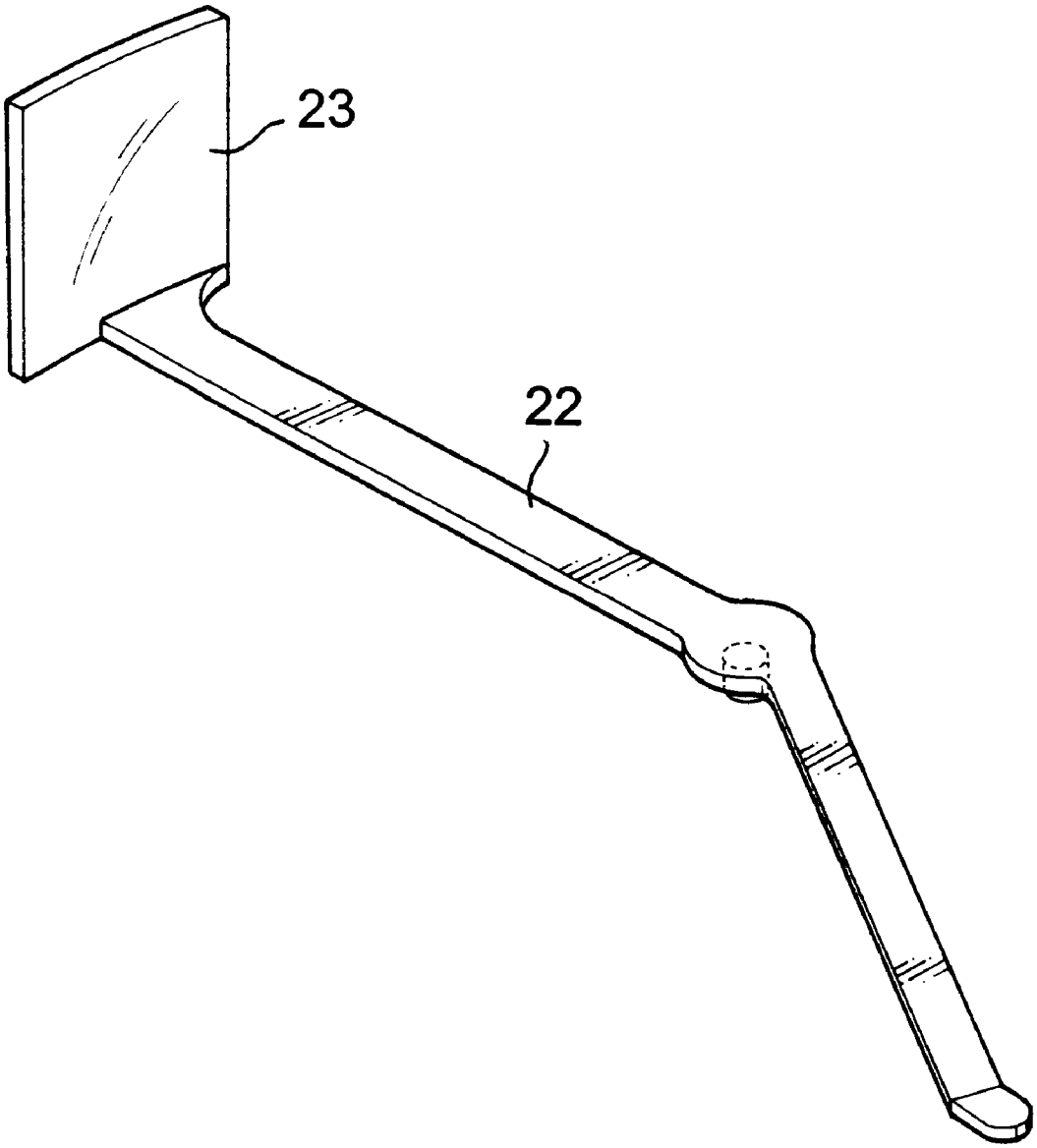
FIG. 6 PRIOR ART
FIG. 6 is a perspective view illustrating a lever constituting the ventilating device of FIG. 5.
Figure 7A:
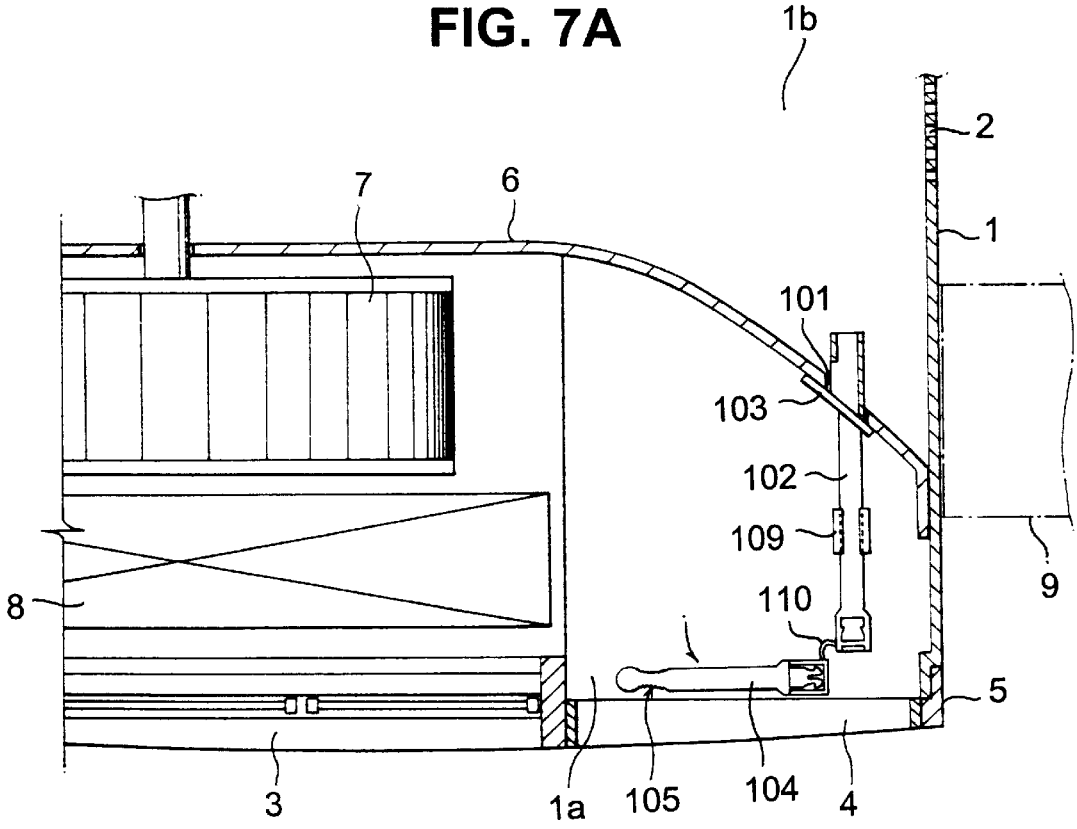
Figure 7B:
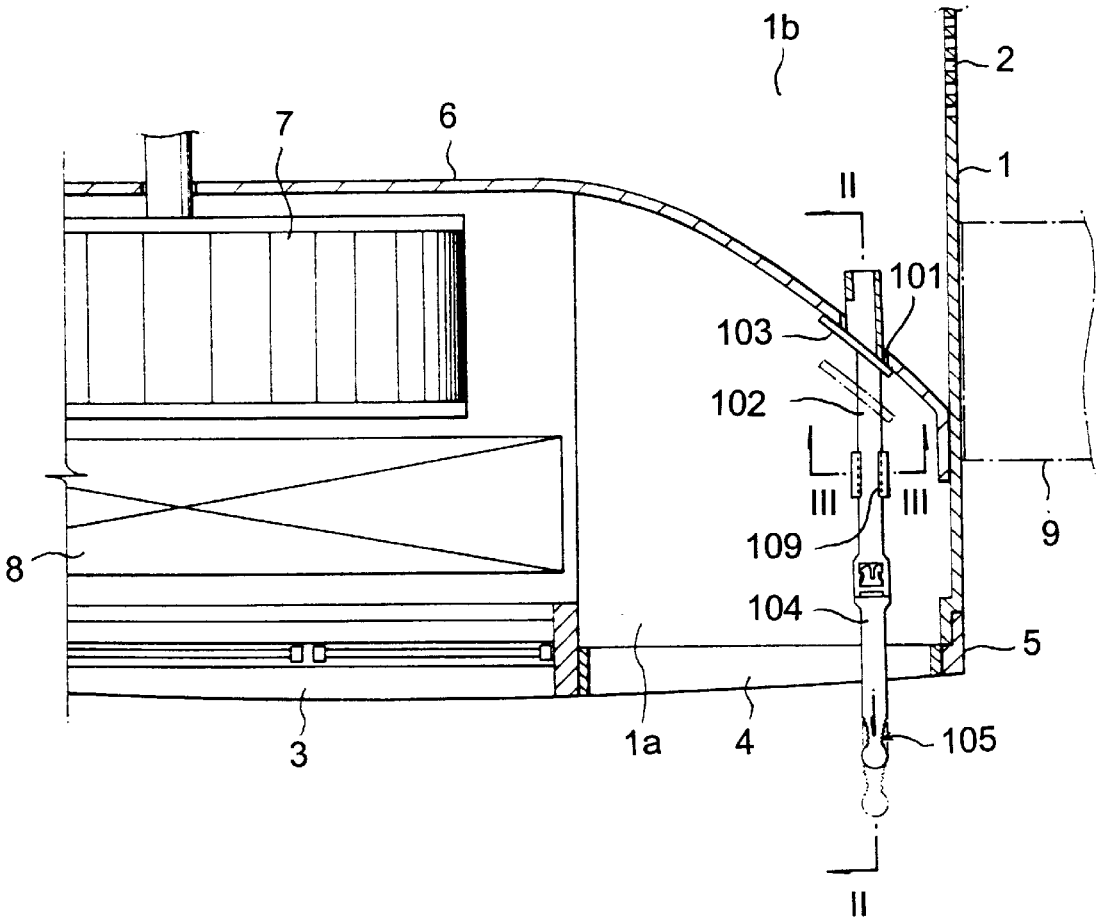
Figure 8:
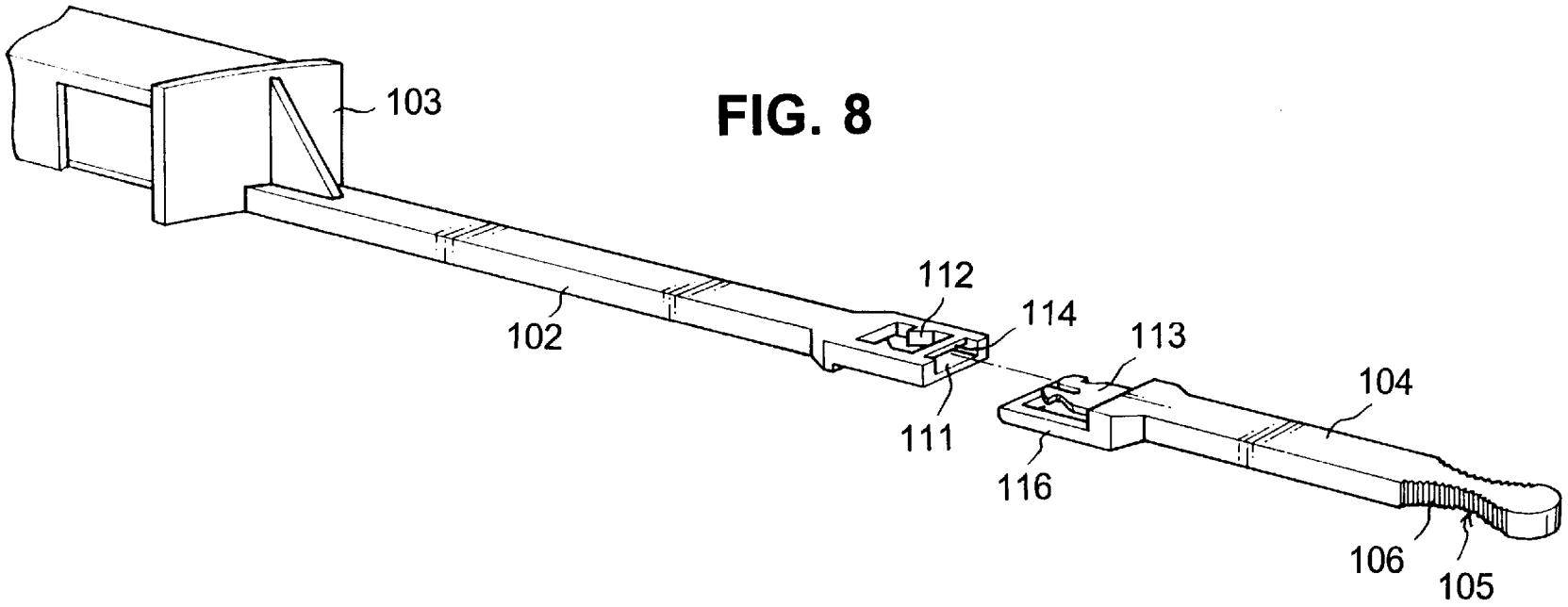
Figure 9:
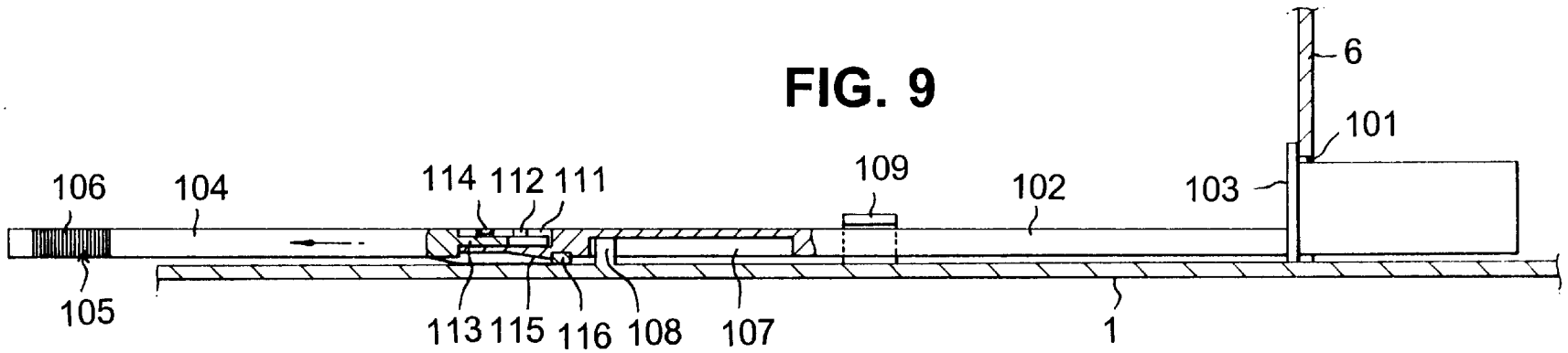
Figure 10:
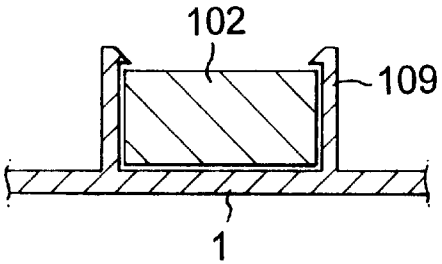
Figure 11A:
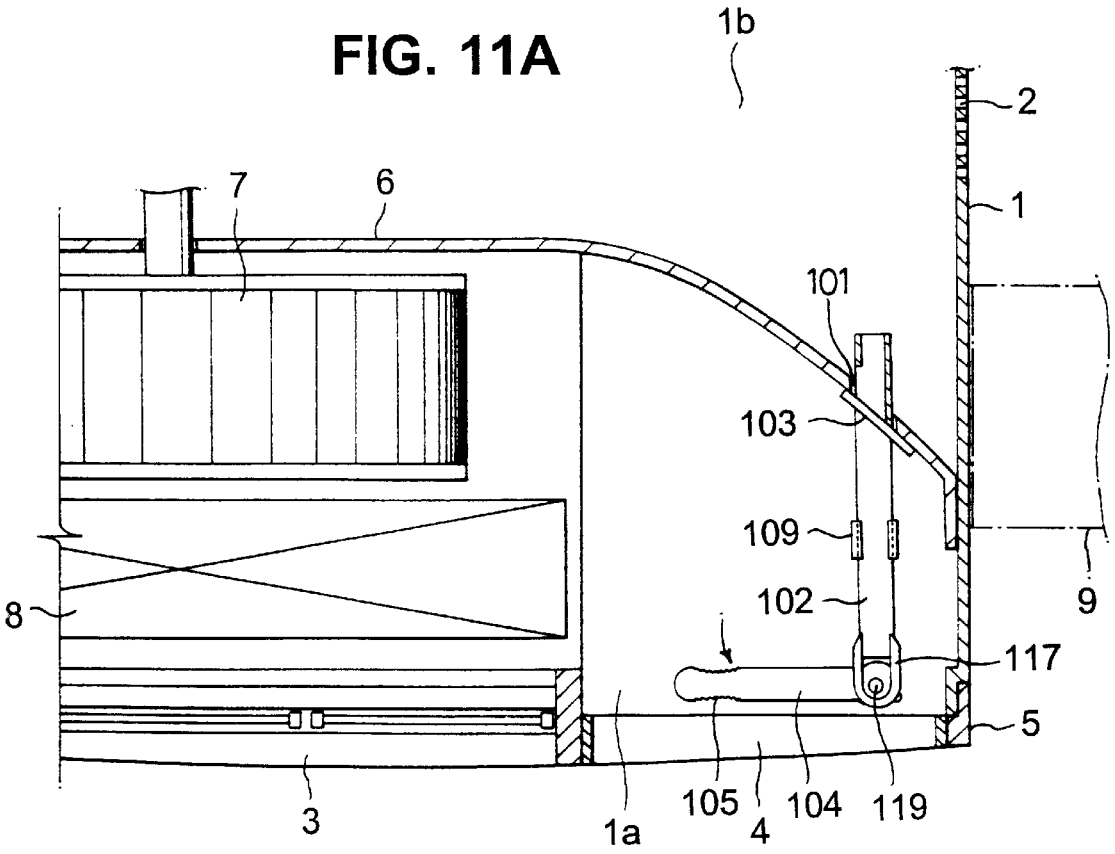
Figure 11B:
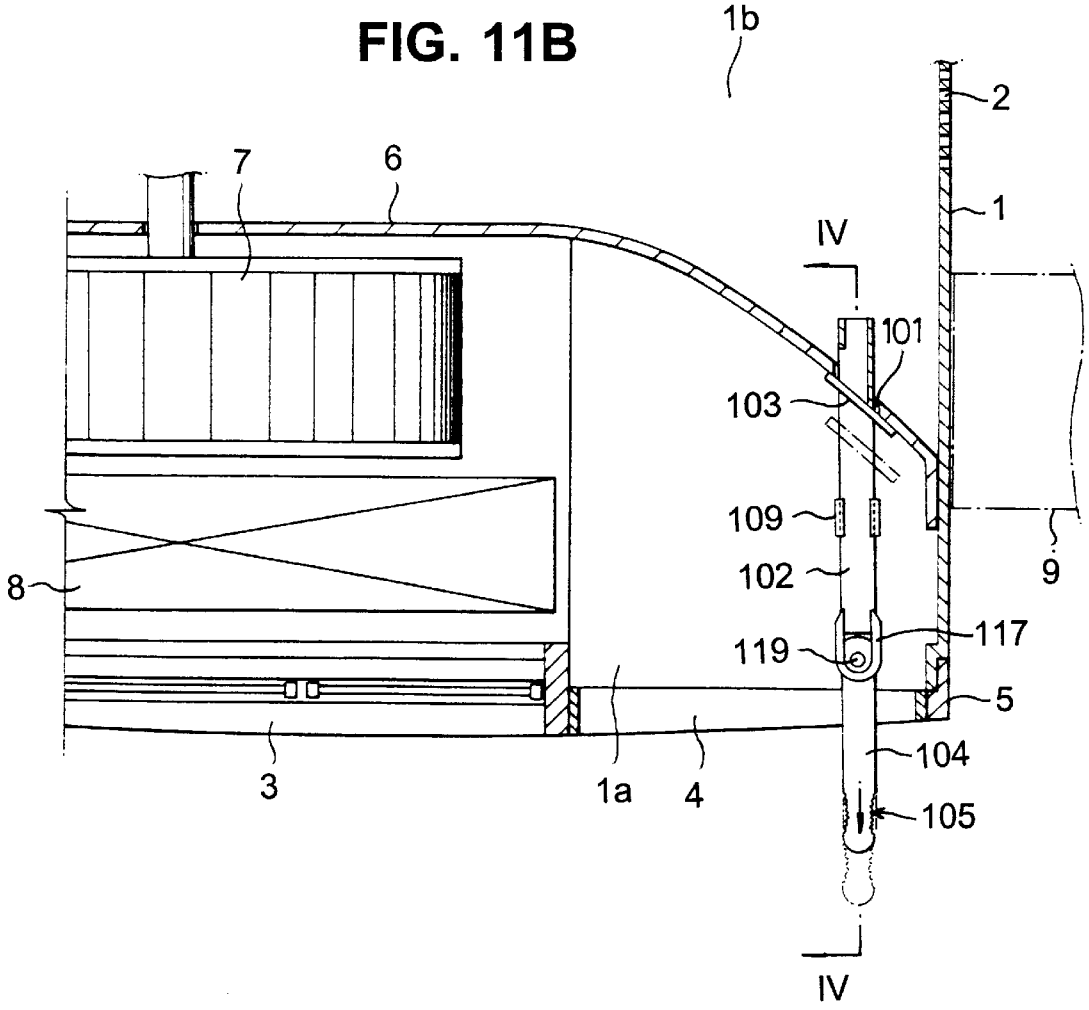
Figure 12:
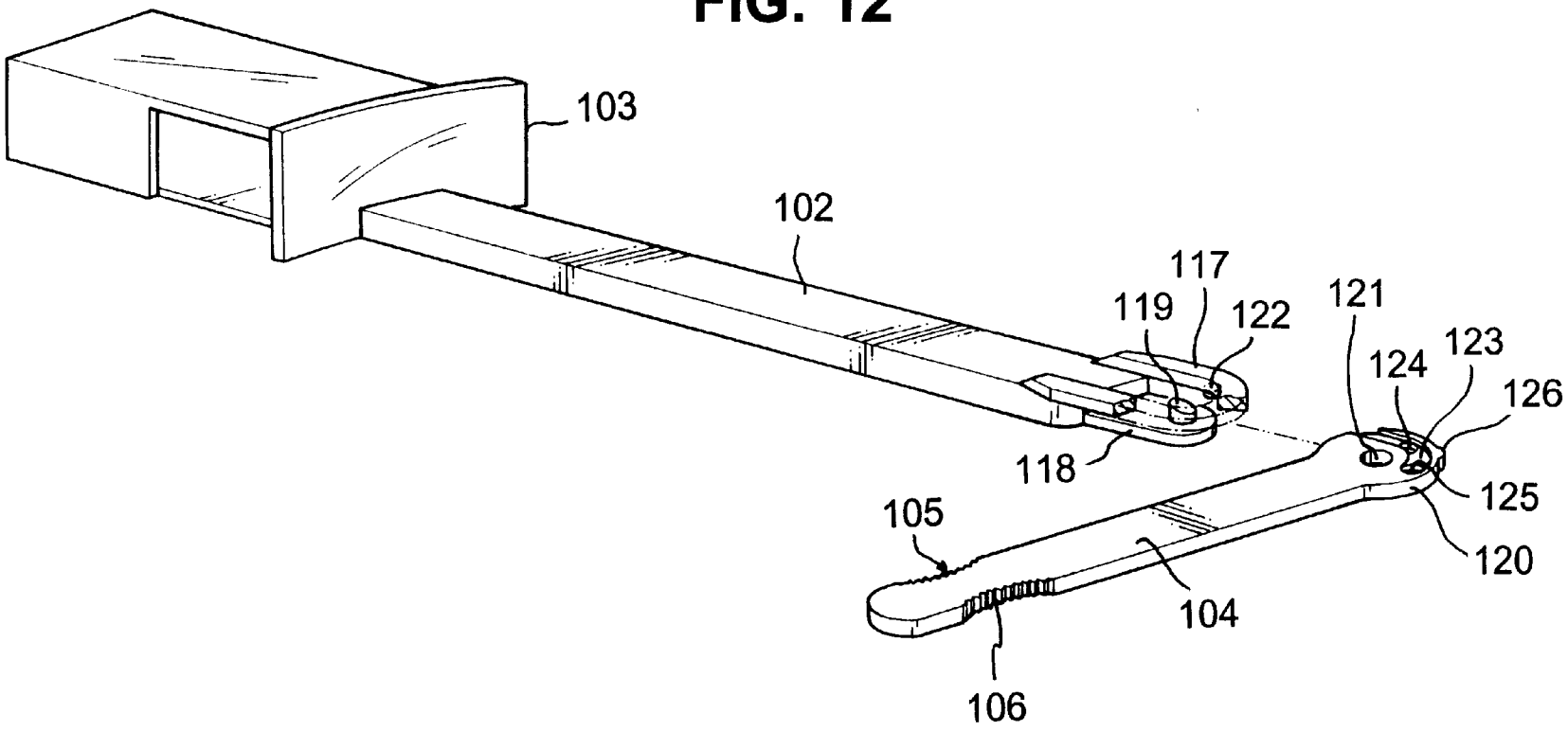
Figure 13:
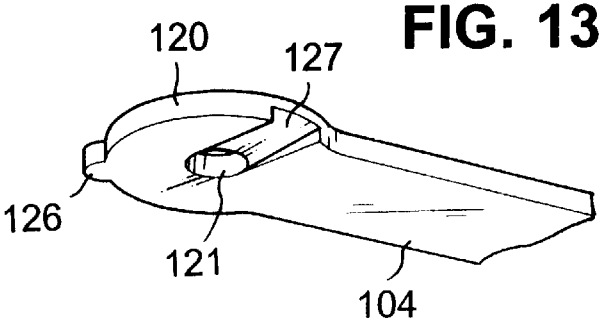
Figure 14:
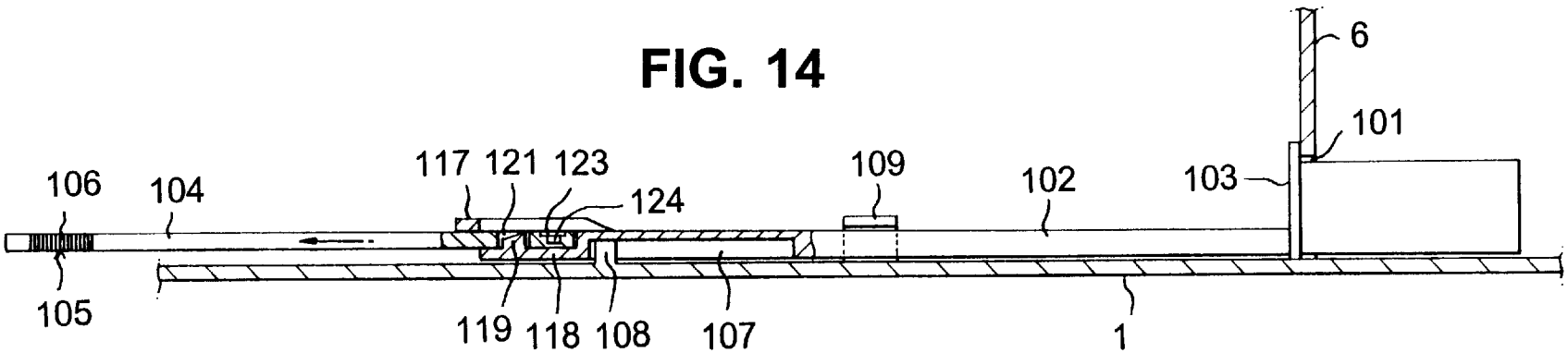
Figure 15:
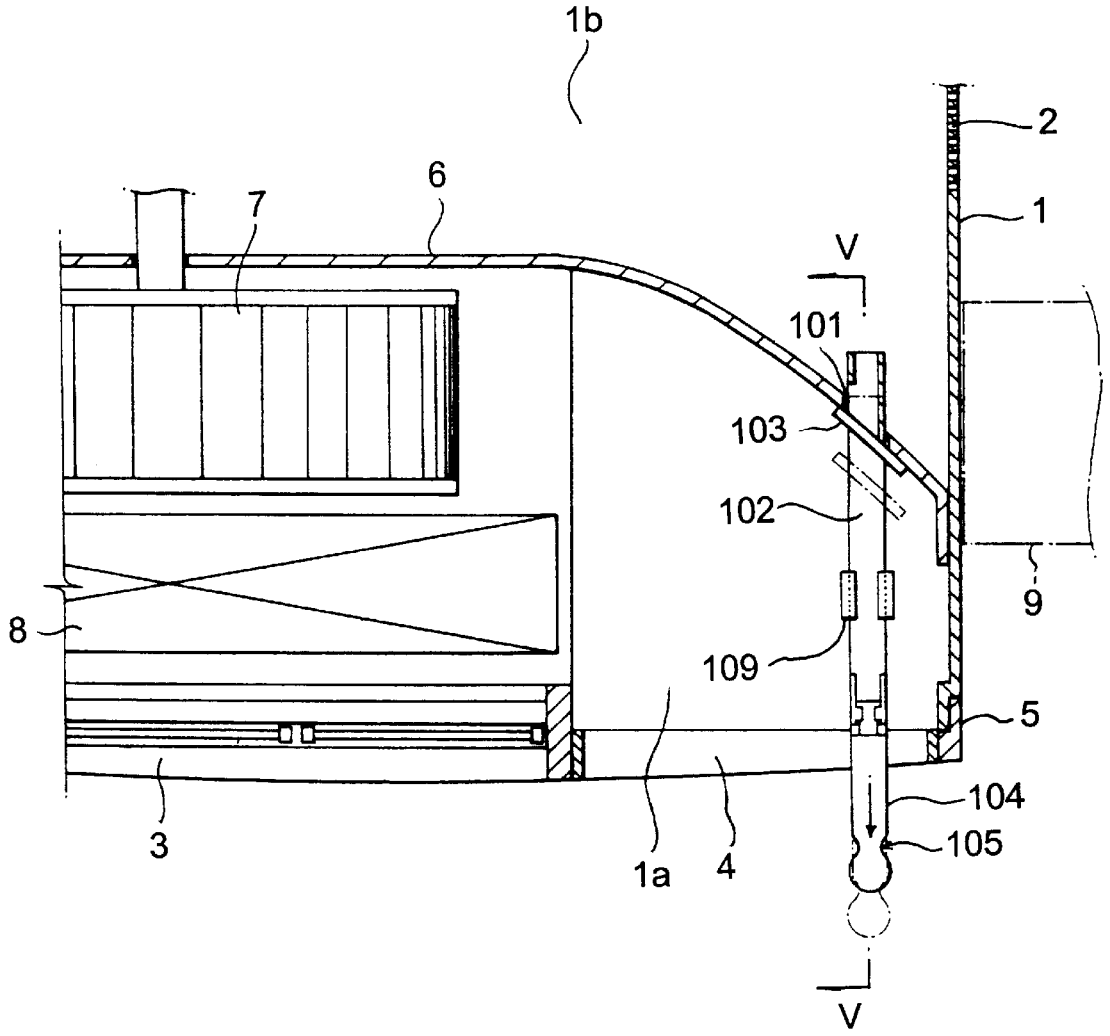
Figure 16:
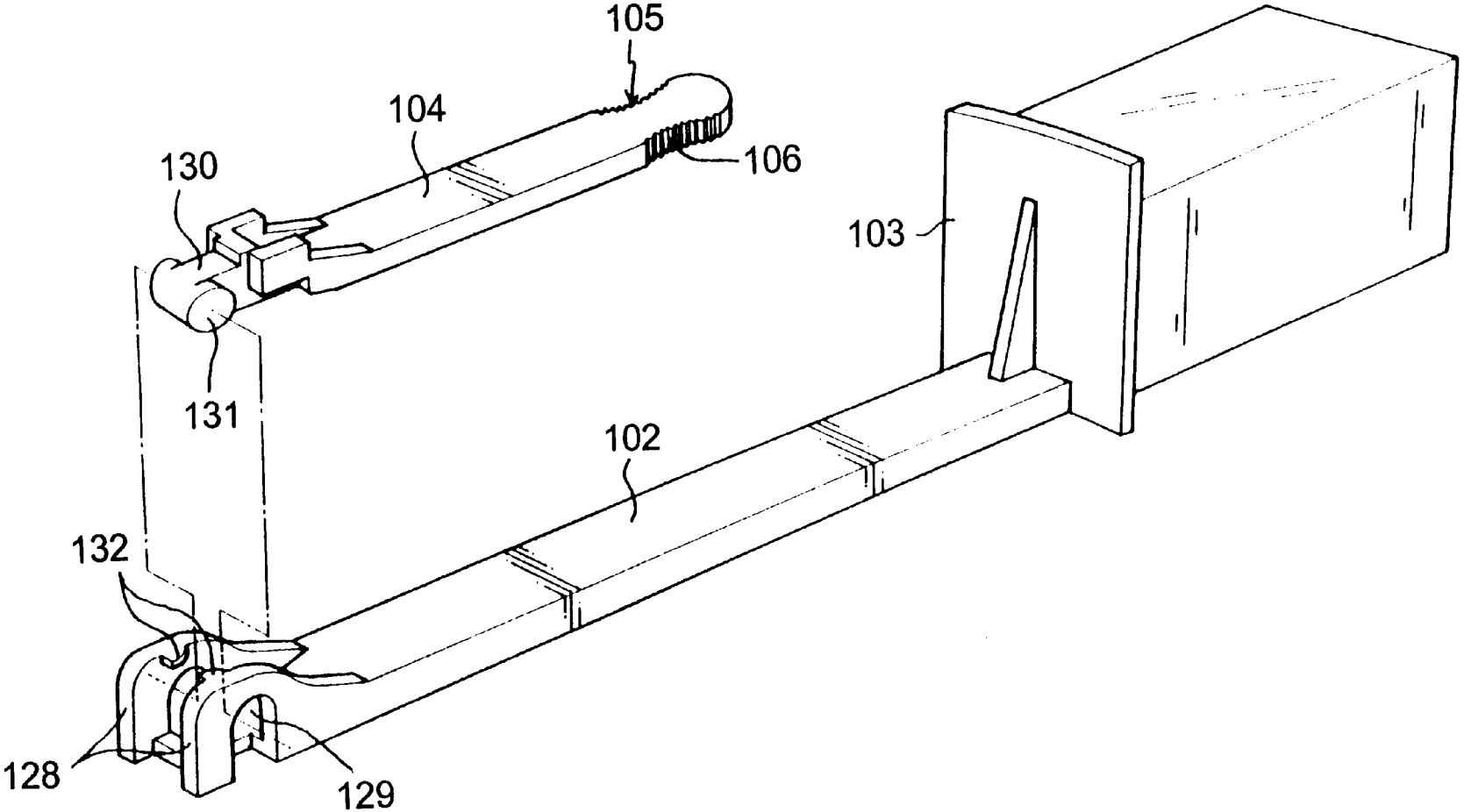
Figure 17A:
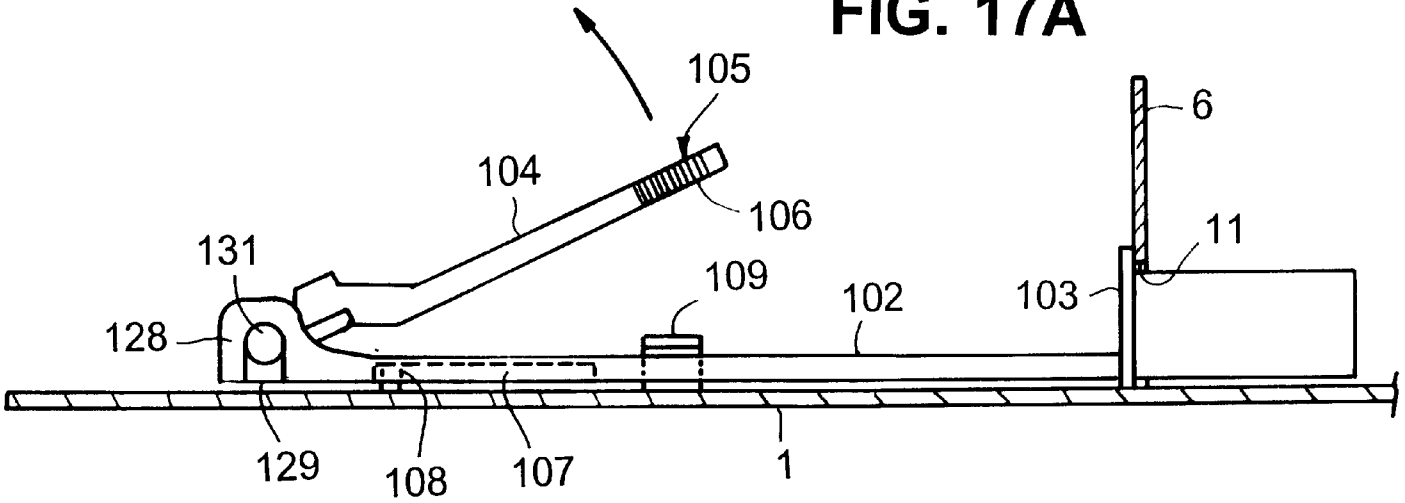
Figure 17B:
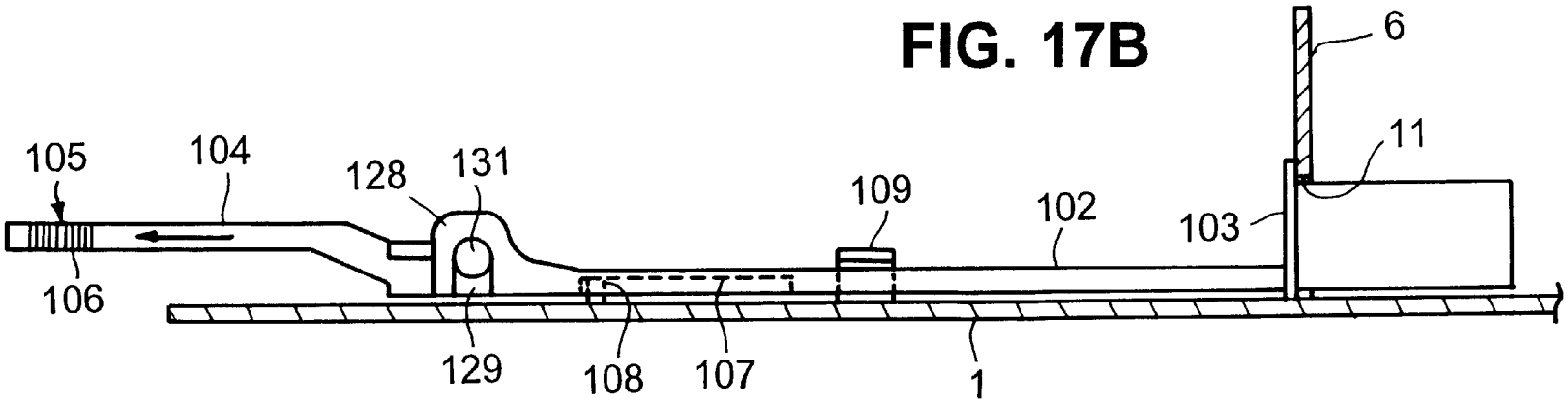

FIGS. 7A and 7B are cross-sectional views illustrating the main parts of a window type air conditioner having a ventilating device constructed according to a first embodiment of the present invention, in which FIG. 7A shows the state in which the whole portion of a second lever is received in a room portion of a body, and FIG. 7B shows the state in which the front end portion of the second lever is exposed to the outside of a front panel of the body;

FIG. 8 is a perspective view illustrating separation between the first and second levers constituting the ventilating device of FIGS. 7A and 7B;

FIG. 9 is a sectional view taken along the line II—II of FIG. 7B;

FIG. 10 is a sectional view taken along the line III—III of FIG. 7B;

FIGS. 11A and 11B are cross-sectional views illustrating the main parts of a window type air conditioner having a ventilating device constructed according to a second embodiment of the present invention. FIG. 11A shows the air conditioner with the whole portion of the second lever in the room portion of the body, and FIG. 7B shows the front end portion of the second lever exposed to the outside of a front panel;

FIG. 12 is a perspective view illustrating separation between the first and second levers of the ventilating device of FIGS. 11A and 11B;

FIG. 13 is a perspective view of a bottom surface illustrating the main parts of the second lever of the ventilating device of FIGS. 11A and 11B;

FIG. 14 is a sectional view taken along the line IV—IV of FIG. 11B;

FIG. 15 is a cross-sectional view illustrating the main parts of a window type air conditioner having a ventilating device constructed according to a third embodiment of the present invention, which shows the state in which the front end portion of a second lever is exposed to the outside of a front panel of the body;

FIG. 16 is a perspective view illustrating the separation between the first and second levers of the ventilating device of FIG. 15;

FIG. 17A is a sectional view taken along the line V—V of FIG. 15, and shows the state in which the whole portion of a second lever is received in the room portion of the body; and FIG. 17B is a sectional view taken along the line V–v of FIG. 15, which shows the state where the front end portion of at second lever is exposed to the outside of a front panel of the body.

DETAILED DESCRIPTION OF PREFERRED EMBODIMENT

Reference will now be made in detail to the preferred embodiments of the present invention, examples of which are illustrated in the accompanying drawings.

First, the construction and effect of a ventilating device of a window type air conditioner according to a first embodiment of the present invention will be discussed in detail with reference to FIGS. 7A to 10.

FIGS. 7A and 7B are cross-sectional views illustrating the main parts of a window type air conditioner having a ventilating device constructed according to a first embodiment of the present invention. FIG. 7A shows the present invention with the whole portion of a second lever in the room portion of the body, and FIG. 7B shows it with the front end portion of the second lever exposed outside of the front panel of the body. FIG. 8 is a perspective view illustrating separation between the first and second levers of the ventilating device of FIGS. 7A and 7B. FIG. 9 is a sectional view taken along the line II—II of FIG. 7B, and FIG. 10 is a sectional view taken along the line III—III of FIG. 7B. In the ventilating device according to the first embodiment of the present invention, a ventilating hole 101 is formed in a partition 6 separating a body 1 into a room portion 1*a* and an outdoor portion 1*b*. The ventilating hole 101 connects the room portion 1*a* with the outdoor portion 1*b*. A first lever 102 moves forward and backward on the bottom surface of the room portion 1*a*. The first lever 102 does not deviate its path and maintains a horizontal state by means of a lever guide portion, during the forward/downward movement. A damper 103 is formed as a unitary body on the back end portion of the first lever 102, and it opens and closes the ventilating hole 101. A second lever 104 is attached to the front end of the first lever 102 and is stored in the room portion 1*a* of the body 1 during product shipment. After the air conditioner is installed, the second lever 104 is turned in a straight line state against the first lever 102, and as a result, is exposed to the exterior of the front panel 5 through the discharge grill 4. A pair of grooves 105, which are formed opposite to each other on the front end of the second lever 104, serve as a handle grip, on which a knurling 106 is formed to prevent sliding.

The lever guide portion is preferably comprised of a vertical groove 107 which is formed in a lengthwise direction on the lower portion of the first lever 102, and a guide projection 108 which is formed on the bottom surface of the room portion 1*a* of the body 1 and is inserted into the vertical groove 107. A pair of hooks 109 which are formed on the bottom surface of the room portion 1*a* of the body 1 for locking the first lever 102, when the guide projection 108 is inserted into the vertical groove 107.

During construction, a thin loop 110 connecting the one side of the rear end of the second lever 104 with the one side of the front end of the first lever 102 is provided. On the first lever 102, a reentrant groove 111 is formed on the upper surface of the front end portion of the first lever 102, and locking protrusions 112 which are formed opposite to each other on both sides of the reentrant groove 111, respectively. The locking protrusion 112 is inclined gradually inward from the outside portion thereof to the inside portion thereof. A locking projection 113, which is formed on the upper portion of the rear end portion of the second lever 104, is inserted into the reentrant groove 111 on the first lever 102, and locked into the locking protrusion 112 and a deviation preventing projection 114. The deviation preventing projection 114 is formed on the top end portion within the reentrant groove 111 of the first lever 102, and it secures the locking projection 113 preventing the locking projection 113 from being deviated from the reentrant groove 111.

On the lower surface of the front end portion of the first lever 102, an auxiliary locking protrusion 115 is formed to incline gradually downward from the front portion thereof to the rear portion thereof. The auxiliary locking projection 116 is formed on the lower surface of the rear end portion of the second lever 105. After the second lever 104 is turned in a straight line by attachment to the first lever 102, when the locking projection 113 on the second lever 104 is inserted into the reentrant groove 111 on the first lever 102, and the auxiliary locking projection 116 is accordingly locked to the auxiliary locking protrusion 115.

Now, the assembling process for the ventilating device, as mentioned above, will be discussed.

First, after the first lever 102, which is integrated with the second lever 104 by the thin loop 110, is inserted into the room portion 1*a* of the body 1, the first lever 102 is pressed downwardly to insert the guide projection 108 into the vertical groove 107. At the time, since the pair of hooks 109 are formed on the bottom surface of the room portion 1*a*, the first lever 102 is hook-locked to each of the hooks.

Next, when the front panel 5 is coupled with the front surface of the body 1, the second lever 104, which is integrated with the first lever 102 by the thin loop 110, is received within the room portion 1*a* of the body 1. In this case, it can be understood that both the first and second levers 102 and 104 are not exposed to the exterior of the front panel 5.

During installation, after the air conditioner is attached to the window 9, the front panel 5 coupled with the body 1 is first detached, and the back end portion of the second lever 104 is grasped by a user's hand and is then moved in a counterclockwise direction. As a result of turning the second lever 104 counterclockwise, due to the thin loop 110, the second lever forms a straight line state against the first lever 102. When the second lever 104 is pushed towards the first lever 102, the second lever 104 couples with the first lever 102 forming a straight line.

During the above assembly procedure, if necessary, the second lever 104 can be completely detached from the first lever 102, and the two levers can be coupled. For this procedure, to separate the two levers, the second lever 104 is twisted or a separate tool is used to cut the thin loop 110, and the second lever 104 is coupled with the first lever 102 to form a straight line.

As shown in FIG. 7A, after the second lever 104 is rotated to form a straight line, or after the second lever 104 is completely detached from the first lever 102 to form a straight line, the second lever 104 is pushed towards the first lever 102, and the locking projection 113 on the second lever 104 is inserted into the reentrant groove 111 on the first lever 102 to be locked to the locking protrusion 112 within the reentrant groove 111. As a result, the second lever 104 is coupled with the first lever 102 in a straight line state, as shown in FIG. 7B. Because the deviation preventing projection 114 on the upper portion of the reentrant groove 111 is in contact with the upper surface of the locking projection 113 of the second lever 104, the locking projection 113 is not easily deviated from the reentrant groove 111. Accordingly, the second lever 104 does not separate from the first lever 102.

Meanwhile, when the locking projection 113 on the second lever 104 is inserted into the reentrant groove 111 on the first lever 102, the auxiliary locking projection 116 of the second lever 104 is locked to the auxiliary locking protrusion 115 of the first lever 102, such that a rigid coupling of the second lever 104 with the first lever 102 is ensured.

Thereafter, when the front panel 5 is coupled with the front surface of the body 1, the whole portion of the first lever 102 is within the room portion 1*a* of the body 1, and the front end portion of the second lever 104 is exposed to the exterior of the front panel 5 through the discharge grill 4.

In the window type air conditioner with the ventilating device of the first embodiment of the present invention, as shown FIGS. 7B and 9, the damper 103 on the first lever 102 closes the ventilating hole 101, such that the room portion 1*a* and the outdoor portion 1*b* within the body 1 are not connected with each other. In this case, although the air conditioner is in an air conditioning state, the outdoor air within the outdoor portion 1*b* flowing through the air holes 2 is not supplied to the room portion 1*a*, preventing the ventilation.

If ventilation is desired, the pair of grooves 105 of the second lever 104, exposed to the exterior of the front panel 5, are grasped and the second lever 104 is pulled out. Thereby, the first lever 102 is moved forward with the second lever 104, and, since the guide projection 108 is inserted into the vertical groove 107 on the first lever 102 and the first lever 102 is hooklocked to the pair of hooks 109, the first lever 102 is not deviated and horizontally moves in a forward direction. Accordingly, as shown by a dotted line of FIG. 7B, since the damper 103 opens the ventilating hole 101, the outdoor air in the outdoor portion 1*b* that cam in through the air holes 2 is supplied to the room portion 1*a* through the ventilating hole 101. The supplied air is mixed with air cooled by the heat exchanger 8 and is discharged to the room through the discharge panel 4. This ventilates, as well as cools, the room.

If ventilation is not desired, the user grasps the second lever 104 and pushes backward. When the pair of grooves 105 on the second lever 104 are grasped to pull out or push back the second lever 104, the knurling 106 formed on the grooves 105 can prevent the user's hand from sliding. FIGS. 11A and 11B are cross-sectional views illustrating the main parts of a window type air conditioner having a ventilating device constructed according to a second embodiment of the present invention. FIG. 11A shows the second lever contained in the room portion of a body, and FIG. 7B shows the second lever extending outside of the front panel of the body. FIG. 12 is a perspective view illustrating separation between the first and second levers of the ventilating device of FIGS. 11A and 11B, and FIG. 13 is a perspective view of a bottom surface illustrating the main parts of the second lever of the ventilating device of FIGS. 11A and 11B. FIG. 14 is a sectional view taken along the line IV—IV of FIG. 11B. In the ventilating device according to the second embodiment of the present invention only the construction of the levers is different from that of the first embodiment of the present invention, explanation on the rest of the components will be avoided for brevity.

Now, the construction of the second lever 104 in the ventilating device according to the second embodiment of the present invention will be discussed in detail.

In construction, an upper supporting member 117 and a lower supporting member 118 are spaced by a predetermined interval on the front end portion of the first lever 102. A center axis 119 is formed on the center portion of the upper portion surface of the lower supporting member 118 and is inclined gradually upward from the front portion thereof to the back portion thereof. A disk type of inserting projection 120 is formed on the back end portion of the second lever 104 and is inserted between the upper supporting member 117 and the lower supporting member 118 on the first lever 102. A center hole 121 is formed on the center portion of the inserting projection 120 and is inserted into the center axis 119 of the lower supporting member 118, when the inserting projection 120 is inserted between the upper supporting member 117 and the lower supporting member 118. As a result, the second lever 104 is coupled with the first lever 102 to be horizontally rotated.

A locking pin 122 is formed on the outside of the lower surface of the upper supporting member 117, and an upper guide groove 123 is installed on the peripheral surface of the upper portion of the inserting projection 120. When rotating the second lever 104, the upper guide groove 123 guides the locking pin 122. First and second locking grooves 124 and 125 are formed within the upper guide groove 123 and selectively lock the locking pin 122 upon the rotation of the second lever 104. A protrusion 126 is formed on the one side of the outside peripheral surface of the inserting projection 120 and is in contact with the side surface of the first lever 102 to suppress the rotation of the second lever 104 where the second lever 104 is locked in a straight line with the first lever 102. A lower guide groove 127 is formed on the lower surface of the inserting projection 120 and is inclined gradually downward from the outside peripheral surface thereof to the center portion thereof. The lower guide groove 127 guides the center axis 119 on the lower supporting member 118, when the inserting projection 120 is inserted between the upper supporting member 117 and the lower supporting member 118 in the state where the second lever 104 is perpendicular to the first lever 102.

Now, the assembly process of each of the components of the ventilating device discussed above.

If the inserting projection 120 on the second lever 104 is inserted between the upper supporting member 117 and the lower supporting member 118 on the first lever 102 in the state where the second lever 104 is perpendicular to the first lever 102, the center axis 119 of the lower supporting member 118 is guided by the lower guide groove 127 of the inserting projection 120. Then, the upper supporting member 117 and the lower supporting member 118 formed on the first lever 102 each open upwardly and downwardly, by their own elastic force due to the characteristic of the mold material, and at the moment that the center axis 119 is completely deviated from the lower guide groove 127, the center axis 119 is inserted into the center hole 121 on the inserting projection 120. Simultaneously, as the open state of the upper supporting member 117 and the lower supporting member 118 is restored to an original state, the inserting projection 120 of the second lever 104 is fully inserted between the upper supporting member 117 and the lower supporting member 118 on the first lever 102. Accordingly, the second lever 104 is perpendicular to the first lever 102 and is rotatable in the horizontal direction. At that time, because the center axis 119 formed on the center portion on the lower supporting member 118 on the first lever 102 is inclined gradually upward from the front portion thereof to the back portion thereof, the center axis 119 is easily guided to the lower guide groove 127 on the inserting projection 120 of the second lever 104.

As explained above, the lower guide groove 127 is inclined gradually downward from the outside peripheral surface thereof to the lower center portion thereof. The guide groove 127 easily guides the center axis 119 into the center hole 121 on the inserting projection 120 of the first lever 102.

When the second lever 104 is perpendicular to the first lever 102 and is horizontally rotated, the locking pin 122 on the upper supporting member 117 of the first lever 102 is guided to the upper guide groove 123 on the inserting projection 120 of the second lever 104 and is locked to the first locking groove 124 of the two locking grooves 124 and 125 on the upper guide groove 123.

When locked, the first lever 102 can be horizontally moved forward and backward, without deviation from the bottom surface of the discharge grill 4, in the same manner as that of the first embodiment of the present invention.

Next, when the front panel 5 is coupled with the front surface of the body 1, the first lever 102 and the second lever 104, which is coupled with the first lever 102, are all received within the room portion 1*a* of the body 1. In this case, it can be understood that both of the first and second levers 102 and 104 are not exposed to the exterior of the front panel 5.

Once the air conditioner is attached to the window 9, the front panel 5 coupled with the body 1 is detached, and the second lever 104, which is perpendicular to the first lever 102, is rotated in a counterclockwise direction. Thereby, the second lever 104 is coupled with the first lever 102 in a straight line state.

More specifically, under the state as shown in FIG. 11A if the second lever 104 is rotated counterclockwise, since the center axis 119 on the first lever 102 is inserted to the center hole 121 on the inserting projection of the second lever 104, that lever 104 rotates on the basis of the center axis 119. At that time, the locking pin 122 on the upper supporting member 117 is detached from the first locking groove 124 within the upper guide groove 123 on the second lever 104 and at the same time, the protrusion 126 on the inserting projection 120 comes in contact with the one side of the first lever 102 preventing further rotation, the second lever 104 forms a straight line with the first lever 102, as shown in FIG. 11B. Under this state, since the locking pin 122 on the upper supporting member 117 is inserted into the second locking groove 125 on the upper guide groove 123, the second lever 104 cannot be reversely rotated Thereafter, when the front panel 5 is coupled with the front surface of the body 1, the whole portion of the first lever 102 is all received within the room portion 1*a* of the body 1, and only the front end portion of the second lever 104, being in a straight state with the first lever 102, is exposed to the exterior of the front panel 5 through the discharge grill 4.

In the window type air conditioner having the ventilating device constructed according to the second embodiment of the present invention, as shown in FIGS. 11B and 14, the damper 103 on the first lever 102 closes the ventilating hole 101, such that the room portion 1*a* and the outdoor portion 1*b*, separated by the partition 6, are not connected with each other. In this case, although the air conditioner is in an air conditioning state, the outdoor air in the outdoor portion 1*b* is not supplied to the room portion 1*a*, thereby preventing ventilation.

If ventilation is desired in the states as shown in FIGS. 11B and 14, the pair of grooves 105 of the second lever 104 outside the front panel 5 are grasped and pulled forward; whereas if ventilation is not desired, the second lever 104 is pushed backward.

FIG. 15 is a cross-sectional view illustrating main parts of a window type air conditioner having a ventilating device constructed according to a third embodiment of the present invention. FIG. 15 shows the air conditioner in the state where the front end portion of a second lever extends outside of a front panel of the body. FIG. 16 is a perspective view illustrating the first and second levers of the ventilating device of FIG. 15 when separated. FIG. 17A is a sectional view taken along the line V—V of FIG. 15, which shows the air conditioner in the state where the whole portion of a second lever is received in a room portion of a body, and FIG. 17B is a sectional view taken along the line V—V of FIG. 15, which shows the state where the front end portion of a second lever is exposed to the outside of a front panel of the body.

In the ventilating device according to the third embodiment of the present invention, only the construction of the levers is different from those of the first and second embodiments of the present invention, and explanation on the remaining components will be avoided for brevity.

Now, the construction of the second lever 104 in the ventilating device according to the third embodiment of the present invention will be discussed in detail.

A pair of hinge members 128, which are formed opposite to each other on the upper surface of the front end portion of the first lever 102, are spaced apart by a predetermined interval. A hinge hole 129 is formed on each of the hinge members 128, and an inserting projection 130, which is formed on the rear end portion of the second lever 104, is inserted between the hinge members 128. A hinge axis 131, which is formed on the end portion of the inserting projection 130, is inserted to the hinge holes 129 on the hinge members 128. The hinge axis 131 is inclined gradually outward from the rear portion thereof to the front portion thereof to be easily inserted into the hinge hole 129. As a result, the second lever 104 is coupled with the first lever 102, and thus is vertically rotatable.

Stoppers 132 are each formed on the top portions of the opposite surfaces of the hinge members 128, each of which has a rounded rear portion edge and a right angle front portion edge. Thereby, under the state where the hinge axis 131 is inserted into the hinge hole 129, the second lever 104 coupled with the first lever 102 is capable of being vertically rotated forming a straight line state against the first lever 102, and when the second lever 104 completes the vertical rotation, the second lever 104 cannot be reversely rotated.

Now, the assembly process of the ventilating device as mentioned above will be discussed.

If the inserting projection 130 on the second lever 104 is inserted between the pair of hinge members 128 on the first lever 102, the hinge axis 131 on the end portion of the inserting projection 130 is forcibly inserted between the pair of hinge members 128 and is then inserted into the hinge hole 129. Hence, in the state where the second lever 104 maintains a predetermined angle against the first lever 102, as shown in FIG. 17A, the second lever 104 is coupled with the front end portion of the first lever 102 and can be vertically rotated.

As explained above, the hinge axis 131, which is formed on the end portion of the inserting projection 130 on the second lever 104, is inclined gradually outward from the rear portion thereof to the front portion thereof. The reason this design is used is that the hinge axis 131 is easily inserted into the hinge hole 129 when the inserting projection 130 of the second lever 104 is inserted between the hinge members 128 on the first lever 102.

Under the above state, after the first lever 102 coupled with the second lever 104 is received within the room portion 1*a* of the body 1, the functioning of the first lever 102 to be horizontally moved forward and backward, without deviation from the bottom surface, is the same as that of the first embodiment of the present invention.

Next, when the front panel 5 is coupled with the front surface of the body 1, the first lever 102 and the second lever 104, which is coupled with the first lever 102 and is vertically rotatable, are all received within the room portion 1*a* of the body 1. In this case, it can be understood that both the first and second levers 102 and 104 are not exposed to the exterior of the front panel 5.

On the other hand, in the case where the air conditioner is attached to the window 9, the front panel 5 coupled with the body 1 is first detached, and the second lever 104 which maintains the predetermined angle against the first lever 102 rotates in a counterclockwise direction. Thereby, the inserting projection 130 on the second lever 104 is inserted between the pair of hinge members 128 on the first lever 102, and thus the hinge axis 131 on the inserting projection 130 is inserted into the hinge hole 129 in the hinge members 128. Accordingly, the second lever 104 completely rotates in the counterclockwise direction and forms a straight line with the first lever 102, as shown in FIG. 17B.

Under this state as shown in FIG. 17A, if the second lever 104, which is coupled with the first lever 102 in the vertical rotatable state, rotates counterclockwise, since the rear portions of the stoppers 132 are rounded, the inserting projection 130 on the second lever 104 is momentarily guided to the rounded portion of the stopper 132. At that time, since the first lever 102 and the hinge members 128 are all made of a mold material, each of the hinge members 128 opens outwardly by receiving the pressurized force of the stopper 132 until the inserting projection 130 passes through the stoppers 132. After the inserting projection 130 completely passes through the stoppers 132, the outwardly opened hinge members 128 are restored to their original state due to the characteristic of the mold material, since the pressurized force of the inserting projection 130 is no longer present. Therefore, as shown in FIG. 17B, once the second lever 104 is completely rotated in the counterclockwise direction to form a straight line with the first lever 102, the stoppers 132 on the hinge members 128 prevent the second lever 104 from being reversely rotated.

Thereafter, when the front panel 5 is recoupled with the front surface of the body 1, the whole portion of the first lever 102 is in the room portion 1*a* of the body 1, and only the front end portion of the second lever 104, when in a straight with the first lever 102, is exposed to the exterior of the front panel 5 through the discharge grill 4.

In the window type air conditioner having the ventilating device constructed according to the third embodiment of the present invention, as shown in FIGS. 15 and 17B, the damper 103 of the first lever 102 closes the ventilating hole 101, such that the room portion 1*a* and the outdoor portion 1*b* are not connected with each other. In this case, although the air conditioner is in an air conditioning state, the outdoor air in the outdoor portion 1*b* is not supplied to the room portion 1*a*, thereby preventing the ventilation.

If ventilation is desired, the pair of grooves 105 of the second lever 104 are grasped and then the second lever 104 is pulled forward, and when ventilation is not further desired, the second lever 104 is pushed backward. As is apparent from the foregoing, a ventilating device of a window type air conditioner according to the present invention can, since the first and second levers are all received within the room portion of the body during the shipment of the product, provide the following advantages: a) upon packaging of the product for shipment, the package area is reduced to decrease the cost of the package as well as the cost of delivery; and b) during packaging and delivery, the tearing off of the package box or the breakage of the first and second levers can be prevented.

In addition, the ventilating device of a window type air conditioner according to the present invention is capable of simplifying the assembly of the first lever, for moving forward and backward in a horizontal state, without deviation, and thereby increase the yield of production.

It will be apparent to those skilled in the art that various modifications and variations can be made in a ventilating device of a window type air conditioner of the present invention without departing from the spirit or scope of the invention. Thus, it is intended that the present invention cover the modifications and variations of this invention provided they come within the scope of the appended claims and their equivalents.

What is claimed is:

1. A ventilating device of a window type air conditioner having a body with a plurality of air holes on the sides and on an upper surface of said body, a front panel attachably/detachably coupled on a front surface of said body with an intake grill and a discharge grill, and a partition fixed in the interior of said body that separates said body into a room portion and an outdoor portion, said ventilating device comprising:

a ventilating hole formed in said partition for connecting said room portion with said outdoor portion;

a first lever movable forwardly and backwardly in said discharge grill of said room portion;

a lever guide portion for preventing said first lever from being deviated when said first lever is moved forward and backward and for maintaining a horizontal state of said first lever;

a damper formed on the back end portion of said first lever for opening and closing said ventilating hole, during the forward/backward movement of said first lever; and a second lever formed on the front end of said first lever and received in said room portion of said body during the shipment of said air conditioner, but turned in a straight line state with said first lever to be exposed to the exterior of said front panel in the front end portion thereof after installation of said air conditioner.

2. The ventilating device of a window type air conditioner as claimed in claim 1, wherein said lever guide portion comprises:

a vertical groove formed in a lengthwise direction on the lower portion of said first lever; a guide projection formed in the bottom surface of said room portion of said body and inserted into said vertical groove; and a pair of hooks formed on the bottom surface of said room portion of said body for hook-locking said first lever, when said guide projection is inserted into said vertical groove.

3. The ventilating device of a window type air conditioner as claimed in claim 1, wherein the one side of the front end of said first lever has a loop that connects to the one side of the rear end of said second lever, a reentrant groove is formed on the upper surface of the front end portion of said first lever, a locking protrusion is formed opposite to each other on both sides of said reentrant groove, respectively, said locking protrusion being inwardly inclined gradually from the outside portion thereof to the inside portion thereof, and a locking projection is formed on the upper portion of the rear end portion of said second lever and is inserted into said reentrant groove on said first lever, to be thereby locked into said locking protrusion, whereby said second lever is attached on the front end of said first lever and is received in said room portion of said body during the shipment of said air conditioner, but is turned in a straight line state with said first lever to be exposed to the exterior of said front panel in the front end portion thereof, after the installation of said air conditioner.

4. The ventilating device of a window type air conditioner as claimed in claim 3, wherein, on the top end portion within said reentrant groove on said first lever, a deviation preventing projection is formed, and in the state where said locking projection on said second lever is inserted into said reentrant groove on said first lever, the upper surface of said locking projection is in contact with said deviation preventing projection.

5. The ventilating device of a window type air conditioner as claimed in claim 3, wherein on the lower surface of the front end portion of said first lever contains an auxiliary locking protrusion that is inclined gradually downward from the front portion thereof to the rear portion thereof, and an auxiliary locking projection is formed on the lower surface of the rear end portion of said second lever, whereby said auxiliary locking projection is locked to said auxiliary locking protrusion in the state where said locking projection on said second lever is inserted into said reentrant groove on said first lever.

6. The ventilating device of a window type air conditioner as claimed in claim 1, wherein on the front end portion of said first lever, an upper supporting member and a lower supporting member are spaced by a predetermined interval, a center axis is formed on the center portion of the upper surface of said lower supporting member, a disk type of an inserting projection is formed on the back end portion of said second lever and is inserted between said upper supporting member and said lower supporting member on said first lever, and a center hole is formed on the center portion of said inserting projection and is inserted into said center axis on said lower supporting member, such that when said inserting projection is inserted between said upper supporting member and said lower supporting member, said second lever is formed on the front end of said first lever and is received in said room portion of said body during the shipment of said air conditioner, but is turned in a straight line state with said first lever to be exposed to the exterior of said front panel in the front end portion thereof, after installation of said air conditioner.

7. The ventilating device of a window type air conditioner as claimed in claim 6, wherein said center axis is upwardly inclined gradually from the front portion thereof to the back portion thereof, thus to be easily inserted into said center hole on said inserting projection, when said inserting projection is inserted between said upper supporting member and said lower supporting member.

8. The ventilating device of a window type air conditioner as claimed in claim 6, wherein on said inserting projection of said second lever, a lower guide groove is formed to be inclined gradually downward from the outside peripheral surface thereof to the center portion thereof, whereby said center axis is guided to said lower guide groove and is easily inserted into said center hole on said inserting projection, when said inserting projection on said second lever is inserted between said upper supporting member and said lower supporting member on said first lever.

9. The ventilating device of a window type air conditioner as claimed in claim 6, wherein on the outside of the lower surface of said upper supporting member, a locking pin is formed, and an upper guide groove is installed on the peripheral surface of the upper surface of said inserting projection, so that when said inserting projection on said second lever is inserted between said upper supporting member and said lower supporting member on said first lever, and said second lever is horizontally rotated, said locking pin is guided to said upper guide groove.

10. The ventilating device of a window type air conditioner as claimed in claim 6, wherein within an upper guide groove, a first locking groove and a second locking groove are formed to have the same radius, and a locking pin is guided by said upper guide groove and is selectively inserted into said first and second locking grooves, when said second lever is horizontally rotated in the state where said inserting projection on said second lever is inserted between said upper supporting member and said lower supporting member on said first lever.

11. The ventilating device of a window type air conditioner as claimed in claim 6, wherein on the one side of the outside peripheral surface of said inserting projection, a protrusion is formed and is in contact with the side surface of said first lever to suppress the rotation of said second lever, so that said second lever forms a straight line state with said first lever.

12. The ventilating device of a window type air conditioner as claimed in claim 1, wherein on the upper surface of the front end portion of said first lever, a pair of hinge members are formed opposite to each other and are spaced by a predetermined interval from each other, a hinge hole is formed on each of said hinge members, an inserting projection is formed on the rear end portion of said second lever and is thus inserted between said hinge members, and a hinge axis is formed on the end portion of said inserting projection and is thus inserted to said hinge hole on said hinge members, whereby said second lever is attached on the front end of said first lever and is received in said room portion of said body during the shipment of said air conditioner, but is rotated to form a straight line state with said first lever so that said second lever is exposed to the exterior of said front panel in the front end portion thereof, after the installation of said air conditioner.

13. The ventilating device of a window type air conditioner as claimed in claim 12, wherein said hinge axis is inclined gradually outward from the rear portion thereof to the front portion to allow it to be easily inserted into said hinge hole, when said inserting projection is inserted between said hinge members.

14. The ventilating device of a window type air conditioner as claimed in claim 12, wherein on the top portions of the opposite surfaces of said hinge members, a plurality of stoppers are formed on the top portions of the opposite surfaces of said hinge members, each of said stoppers having a rounded rear portion edge and a right angle front portion edge, whereby under the state where said second lever is vertically rotated to form a straight line state with said first lever, said stoppers are in contact with said inserting projection on said second lever, and thus the second lever is not reversely rotatable.

15. The ventilating device of a window type air conditioner as claimed in claim 1, wherein on the front end of said second lever contains a pair of grooves that are formed opposite to each other and serve as a handle grip, and a knurling that is formed on said grooves to prevent sliding.

* * * * *